US011624137B2

(12) United States Patent
Cannon et al.

(10) Patent No.: US 11,624,137 B2
(45) **Date of Patent: *Apr. 11, 2023**

(54) LAUNDRY TREATING APPLIANCE HAVING A TREATING TOOL

(71) Applicant: WHIRLPOOL CORPORATION, Benton Harbor, MI (US)

(72) Inventors: Marcus A. Cannon, Saint Joseph, MI (US); Scott E. Carpenter, Wanatah, IN (US); Joel M. Sells, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 27 days.

This patent is subject to a terminal disclaimer.

(21) Appl. No.: 17/324,247

(22) Filed: May 19, 2021

(65) Prior Publication Data

US 2021/0269956 A1 Sep. 2, 2021

Related U.S. Application Data

(63) Continuation of application No. 16/587,913, filed on Sep. 30, 2019, now Pat. No. 11,060,224.

(60) Provisional application No. 62/748,795, filed on Oct. 22, 2018.

(51) Int. Cl.

| | |
|---|---|
| ***D06F 29/00*** | (2006.01) |
| ***A46B 11/00*** | (2006.01) |
| ***D06F 21/02*** | (2006.01) |
| ***D06F 39/02*** | (2006.01) |

(52) U.S. Cl.

CPC ..... *D06F 29/00* (2013.01); *A46B 11/001* (2013.01); *D06F 21/02* (2013.01); *D06F 39/02* (2013.01); *A46B 2200/3053* (2013.01)

(58) Field of Classification Search

CPC ..... D06F 29/00

See application file for complete search history.

(56) References Cited

U.S. PATENT DOCUMENTS

| | | | |
|---|---|---|---|
| 3,209,560 | A | 10/1965 | Shelton |
| 3,490,254 | A | 1/1970 | Mason |
| 6,353,954 | B1 | 3/2002 | Dunsbergen et al. |
| 8,549,887 | B2 | 10/2013 | Reid et al. |
| 9,247,805 | B1 | 2/2016 | Malm |
| 9,903,063 | B2 | 2/2018 | Carpenter et al. |
| 2016/0138207 | A1 | 5/2016 | Del Pos et al. |
| 2018/0100262 | A1 | 4/2018 | Prushinskiy et al. |
| 2018/0340287 | A1 | 11/2018 | Carpenter |

FOREIGN PATENT DOCUMENTS

| | | | |
|---|---|---|---|
| WO | 2011128745 | A2 | 10/2011 |

*Primary Examiner* — Jason Y Ko

(74) *Attorney, Agent, or Firm* — McGarry Bair PC

(57) ABSTRACT

Aspects of the disclosure relate to a laundry treating appliance including a chassis defining an interior and a treating chamber located within the interior. A dispenser of the laundry treating appliance can include at least one treating chemistry reservoir fluidly coupled to the treating chamber. The laundry treating appliance can further include a treating tool.

20 Claims, 11 Drawing Sheets

LAUNDRY TREATING APPLIANCE HAVING A TREATING TOOL

CROSS-REFERENCE TO RELATED APPLICATIONS

This application is a continuation application of U.S. patent application Ser. No. 16/587,913, filed Sep. 30, 2019, now U.S. Pat. No. 11,060,224, issued Jul. 13, 2021, which claims the benefit of U.S. Provisional Patent Application No. 62/748,795, filed on Oct. 22, 2018, both of which are incorporated herein by reference in their entirety.

BACKGROUND

Laundry treating appliances, such as washing machines, refreshers, and non-aqueous systems, can have a configuration based on a rotating container that at least partially defines a treating chamber in which laundry items are placed for treating. The laundry treating appliance can have a controller that implements a number of user-selectable, pre-programmed cycles of operation. Hot water, cold water, or a mixture thereof along with various treating chemistries, or detergents, can be supplied to the treating chamber in accordance with the cycle of operation. In vertical or horizontal axis washing machines a detergent dispenser can be in the form of a drawer fluidly coupled to the treating chamber to receive a volume of detergent to treat the laundry items according to the cycle of operation. The drawer usually includes containers for treating chemistries such as detergent or fabric softener and can supply the treating chemistries to the treating chamber via a conduit.

Laundry treating appliances typically operate to treat laundry items by placing the laundry items in contact with cleaning fluid such as soapy water, and providing relative motion between the laundry items and the fluid. Commonly, a fabric mover, such as an agitator, provides mechanical energy to a load of laundry items immersed in the cleaning fluid by agitating the laundry load in a manner that both jostles the laundry items in the fluid and circulates the fluid through the laundry items. A laundry treating appliance for home use can perform a select programmed series of operations on fabric placed in a basket or drum located within the interior of the machine. However, it can occur that none of a selection of preprogrammed wash cycles is thought by the washing machine user to be sufficient to fully remove certain stains on the fabric being laundered. The user can choose to address such stains manually before adding the stained laundry items to the laundry load.

BRIEF SUMMARY

In one aspect, the present disclosure relates to a laundry treating appliance including a chassis defining an interior, a treating chamber located within the interior, a drawer slidably received within the interior and containing a dispenser having at least one treating chemistry reservoir fluidly coupled to the treating chamber, and a treating tool having an internal treating chemistry reservoir and positioned within the dispenser to fluidly couple the internal treating chemistry reservoir with the treating chamber.

In another aspect, the present disclosure relates to a laundry treating appliance including a chassis defining an interior, a treating chamber located within the interior and having a fluid inlet, a removable treating tool having an internal treating chemistry reservoir with a fluid outlet, and a fluid coupling between the fluid outlet of the internal treating chemistry reservoir and the fluid inlet of the treating chamber.

DETAILED DESCRIPTION OF THE DISCLOSURE

Figure 1:
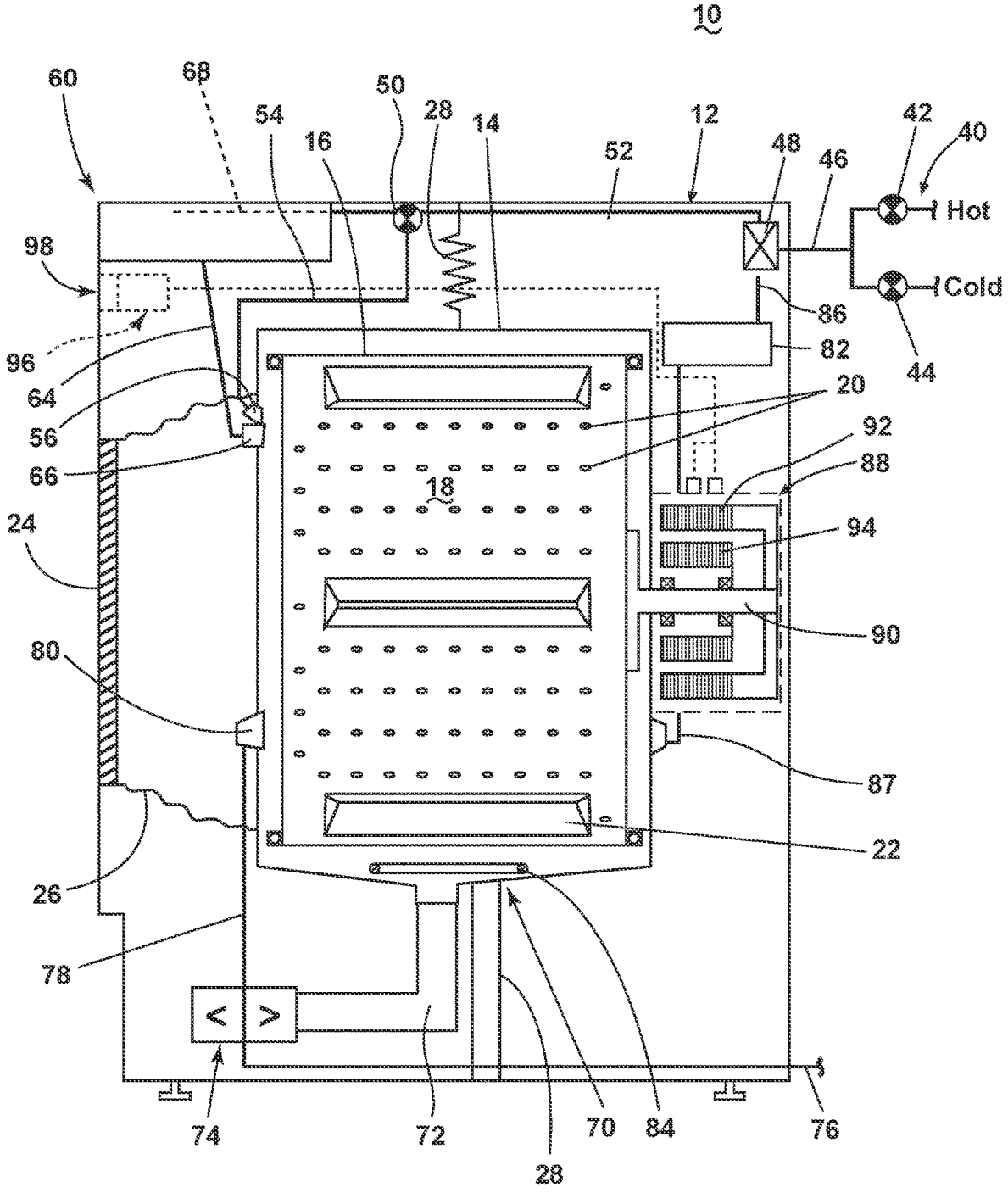
FIG. 1 is a schematic cross-sectional view of a laundry treating appliance in the form of a washing machine including a dispenser according to an aspect of the present disclosure.

FIG. 1 is a schematic view of a laundry treating appliance according to aspects of the present disclosure. The laundry treating appliance can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance of FIG. 1 is illustrated as a horizontal axis, front-load laundry treating appliance, the aspects of the present disclosure can have applicability in laundry treating appliances with other configurations.

Washing machines are typically categorized as either a vertical axis washing machine or a horizontal axis washing machine. As used herein, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination. Similar to the horizontal axis washing machine, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The laundry treating appliance of FIG. 1 is illustrated as a horizontal-axis washing machine 10, which can include a structural support system including a cabinet 12, which defines a housing within which a laundry holding system resides. The cabinet 12 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system includes a tub 14 supported within the cabinet 12 by a suitable suspension system and a drum 16 provided within the tub 14. The drum 16 defines at least a portion a laundry treating chamber 18 for receiving a laundry load for treatment. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It can also be within the scope of the present disclosure for the laundry holding system to comprise only one receptacle with the receptacle defining the laundry treating chamber for receiving the load to be treated.

The laundry treating chamber 18 can have an opening or open face that can be selectively closed by a cover, such as a door 24. More specifically, the door 24 can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The washing machine 10 can further include a suspension system 28 for dynamically suspending the laundry holding system within the structural support system.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The washing machine 10 can also be provided with a dispensing system for dispensing treating chemistry to the treating chamber 18 for use in treating the laundry according to a cycle of operation. The dispensing system can include a treating chemistry dispenser 60 which can be a single dose dispenser, a bulk dispenser, or an integrated single dose and bulk dispenser and is fluidly coupled to the treating chamber 18. The treating chemistry dispenser 60 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 60 from the supply conduit 52 by directing the diverter mechanism 50 to direct the flow of water to a dispensing supply conduit 68.

The treating chemistry dispenser 60 can include multiple chambers or reservoirs fluidly coupled to the treating chamber 18 for receiving doses of different treating chemistries. The treating chemistry dispenser 60 can be implemented as a dispensing drawer that is slidably received within the cabinet 12, or within a separate dispenser housing which can be provided in the cabinet 12. The treating chemistry dispenser 60 can be moveable between a fill position, where the treating chemistry dispenser 60 is exterior to the cabinet 12 and can be filled with treating chemistry, and a dispense position, where the treating chemistry dispenser 60 is interior of the cabinet 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 54 and/or the conduit 64 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry, can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The washing machine 10 also includes a drive system for rotating the drum 16 within the tub 14. The drive system can include a motor 88 for rotationally driving the drum 16. The motor 88 can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled with the drum 16 through a belt and a drive shaft to rotate the drum 16, as is known in the art. Other motors, such as an induction motor or a permanent split capacitor (PSC) motor, can also be used. The motor 88 can rotationally drive the drum 16 including that the motor 88 can rotate the drum 16 at various speeds in either rotational direction.

The control system can control the operation of the washing machine 10 to implement one or more cycles of operation. The control system can include a controller 96 located within the cabinet 12 and a user interface 98 that can be operably coupled with the controller 96. The user interface 98 can provide an input and output function for the controller. The user interface 98 can include one or more knobs, dials, switches, displays, touchscreens, and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection, and cycle parameters, such as cycle options. Other communications paths and methods can also be included in the washing machine 10 and can allow the controller 96 to communicate with the user in a variety of ways. For example, the controller 96 can be configured to send a text message to the user, send an electronic mail to the user, or provide audio information to the user either through the washing machine 10 or utilizing another device such as a mobile phone.

The controller 96 can include the machine controller and any additional controllers provided for controlling any of the components of the washing machine 10. For example, the controller 96 can include the machine controller and a motor controller. Many known types of controllers can be used for the controller 96. The specific type of controller is not germane to the present disclosure. It is contemplated that the controller can be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
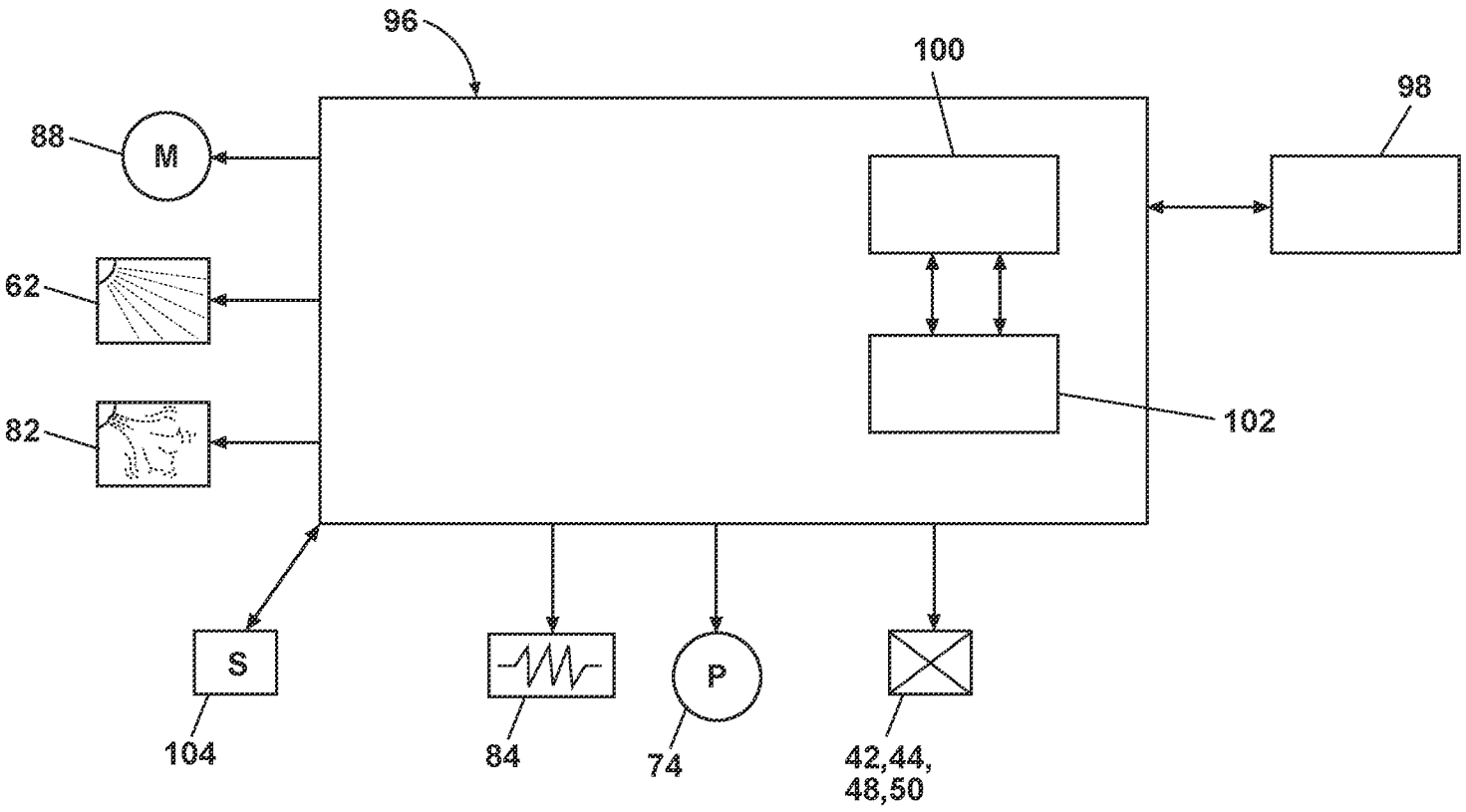
FIG. 2 is a schematic representation of a control system for controlling the operation of the laundry treating appliance of FIG. 1.

As illustrated in FIG. 2, the controller 96 can be provided with a memory 100 and a central processing unit (CPU) 102. The memory 100 can be used for storing the control software that can be executed by the CPU 102 in completing a cycle of operation using the washing machine 10 and any additional software. For example, the memory 100 can store a set of executable instructions including at least one user-selectable cycle of operation. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the washing machine 10 that can be communicably coupled with the controller 96. The database or table can be used to store the various operating parameters for the one or more cycles of operation, including factory default values for the operating parameters and any adjustments to them by the control system or by user input.

The controller 96 can be operably coupled with one or more components of the washing machine 10 for communicating with and controlling the operation of the component to complete a cycle of operation. For example, the controller 96 can be operably coupled with the motor 88, the pump 74, the treating chemistry dispenser 60, the steam generator 82 and the sump heater 84 to control the operation of these and other components to implement one or more of the cycles of operation.

The controller 96 can also be coupled with one or more sensors 104 provided in one or more of the systems of the washing machine 10 to receive input from the sensors 104, which are known in the art and not shown for simplicity. Non-limiting examples of sensors 104 that can be communicably coupled with the controller 96 include: a treating chamber temperature sensor, a moisture sensor, a weight sensor, a chemical sensor, a position sensor, an imbalance sensor, a load size sensor, and a motor torque sensor, which can be used to determine a variety of system and laundry characteristics, such as laundry load inertia or mass.

Figure 3:
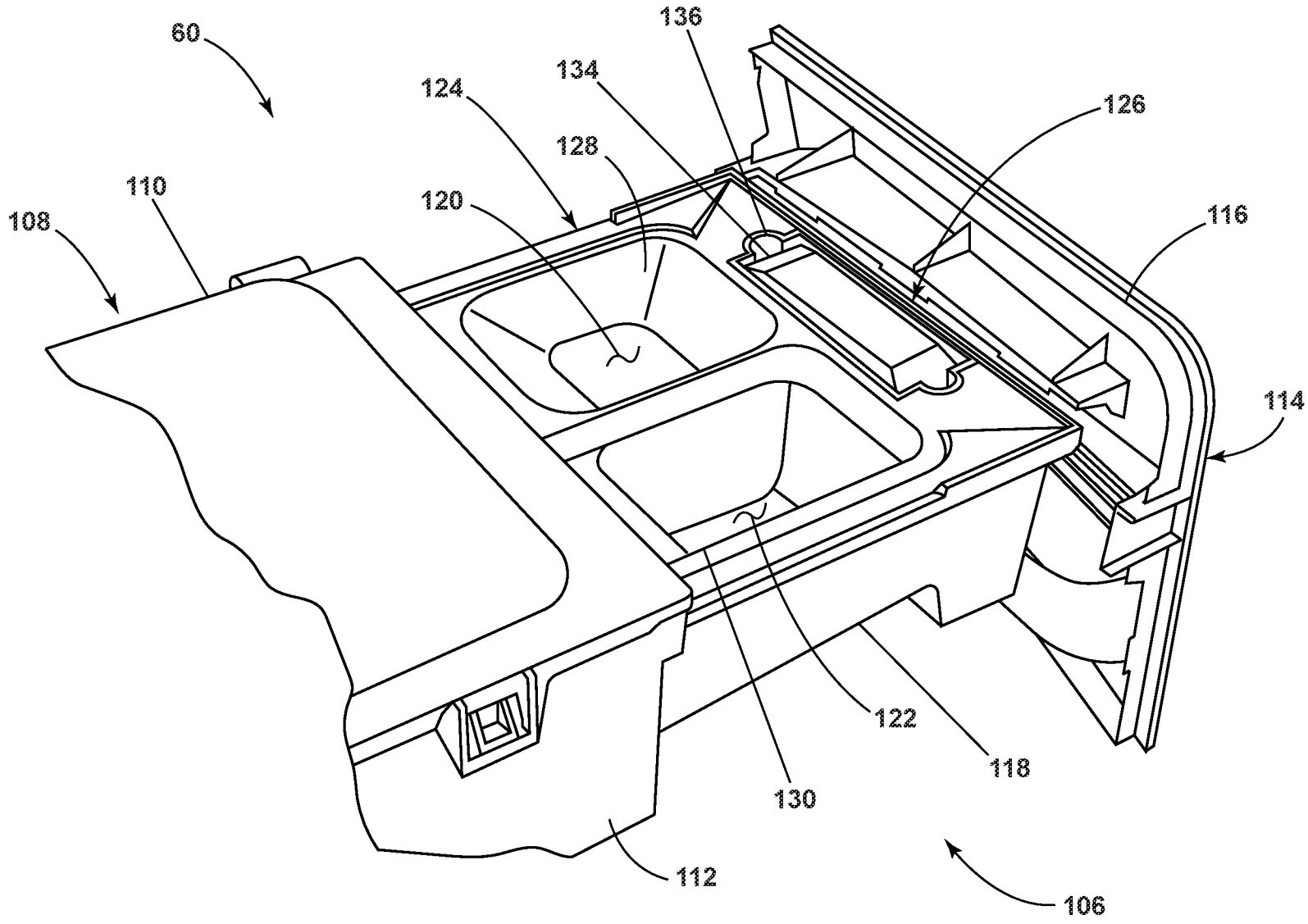
FIG. 3 is a perspective view of the dispenser of FIG. 1 with a treating tool docked in a tool docking station.

FIG. 3 illustrates a perspective view of the treating chemistry dispenser 60 comprising a drawer housing 108 and a dispenser drawer 106 slidably received within the drawer housing 108 for movement between a closed condition and an opened condition. The drawer housing 108 can include an upper housing 110 and a lower housing 112. The dispenser drawer 106 comprises a drawer front 114 having a peripheral edge 116, a drawer body 118 defining and carrying at least a first reservoir 120 and a second reservoir 122, and a drawer cover 124. The drawer front 114 can be mounted to the drawer body 118. The drawer cover 124 defines and carries a tool docking station 126, a first pour opening 128, and at least a second pour opening 130. The tool docking station 126 defines a tool recess 132. A treating tool 134 can be received within the tool recess 132. The treating tool 134 can rest loosely within the tool docking station 126, or can fit snugly within the tool docking station 126, such as by a snap fit arrangement. The treating tool 134 can be any suitable tool for treating or pre-treating laundry items, such as a brush for stain treatment.

Figure 4:
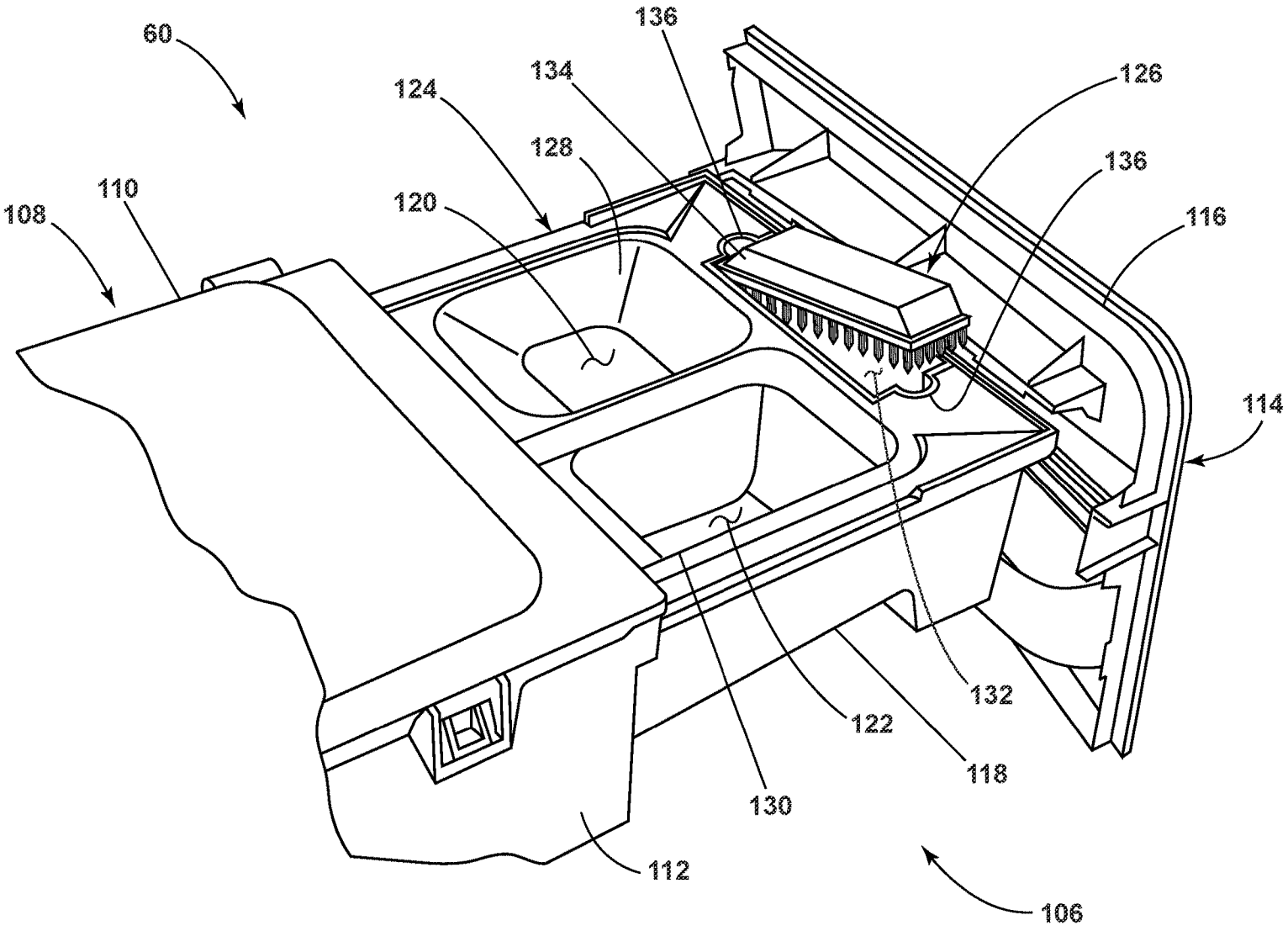
FIG. 4 is a perspective view of the dispenser of FIG. 1 with a treating tool partially docked in a tool docking station.

FIG. 4 illustrates the treating tool 134 partially received within the tool recess 132 of the tool docking station 126. The tool docking station 126 can further comprise at least one finger recess 136 that can be provided to allow a user to place a finger in the finger recess 136 in order to remove the treating tool 134 from the tool docking station 126. While the tool docking station 126 is illustrated herein as including two finger recesses 136, the two finger recesses 136 provided at opposite ends of the tool recess 132 and aligned with opposite ends of the treating tool 134, it will be understood that any number of finger recesses 136 can be included, non-limiting examples of which include only a single finger recess 136, or four finger recesses 136 provided with one finger recess 136 at each side of the tool recess 132, or multiple finger recesses 136 per side of the tool recess 132.

Figure 5:
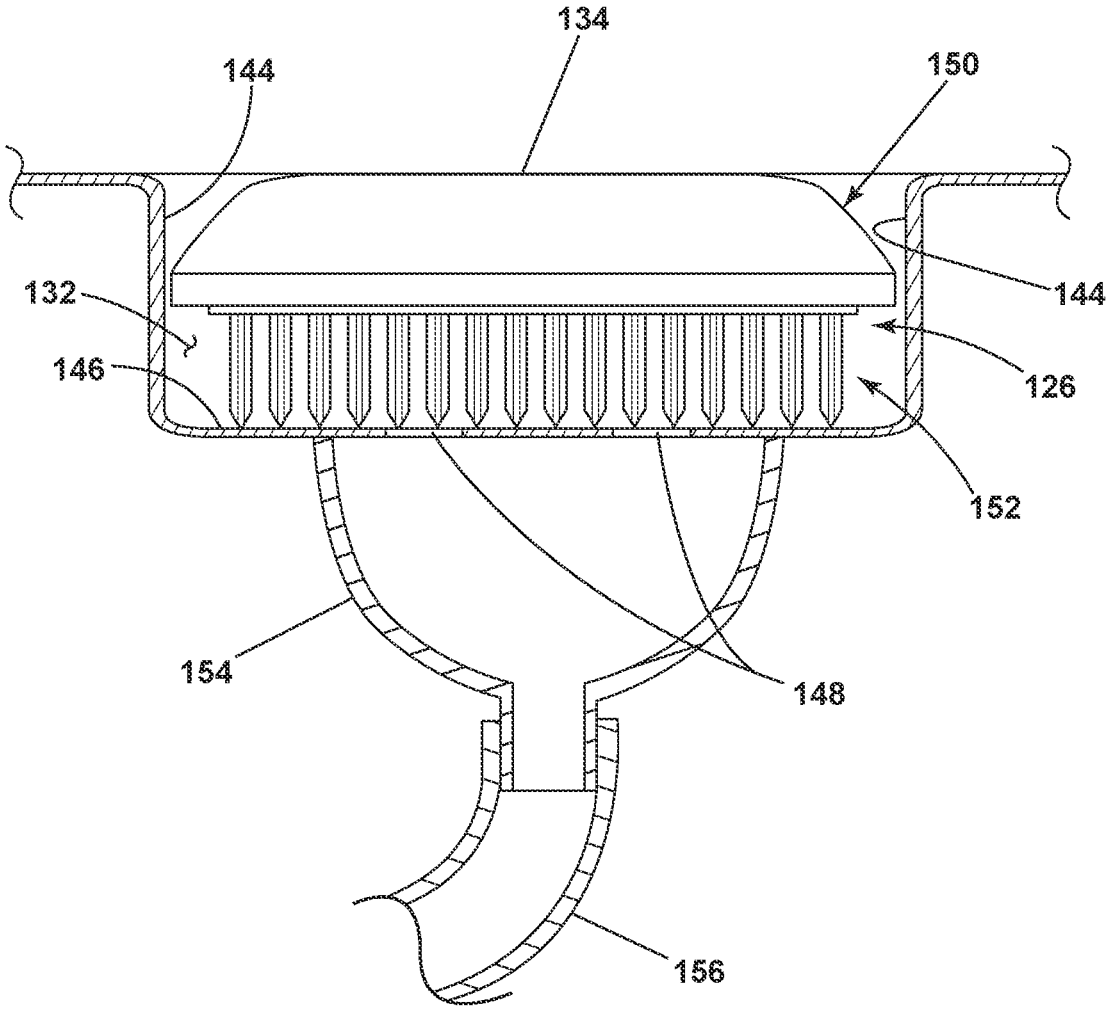
FIG. 5 is a cross-sectional view of the treating tool docked in the tool docking station of FIG. 3.

FIG. 5 illustrates a cross-sectional view of the treating tool 134 docked within the tool docking station 126. It can be seen that the treating tool 134 comprises a handle 150 with a set of bristles 152 extending downwardly from the handle 150. While the treating tool 134 is illustrated herein as having a height that is similar to the height of the side walls 144, it will be understood that the treating tool 134 can have any suitable design and height such that the treating tool 134 conforms to the relative size of the tool recess 132. The treating tool 134 can have a height that extends above the height of the tool recess 132, or the treating tool 134 height can not extend to the height of the tool recess 132. In addition, while the treating tool 134 has been illustrated herein as having a generally rectangular shape, it will be understood that any suitable shape is contemplated, non-limiting examples of which include circular, oval, elliptical, square, rectangular, trapezoidal, etc.

The tool recess 132 is defined by side walls 144 and a bottom wall 146. The bottom wall 146 can define at least one drain opening 148 that fluidly couples the tool recess 132 and the tool docking station 126 to the treating chamber 18. Further, the tool recess 132 and tool docking station 126 can be fluidly coupled to the treating chamber 18 via the at least one treating chemistry reservoir 120, 122. In the aspect illustrated in FIG. 3 and FIG. 4, where the tool docking station 126 is provided within the drawer cover 124, the tool docking station 126, or at least a portion of the tool docking station 126, and the at least one drain opening 148 can overlie at least one of the treating chemistry reservoirs 120, 122. For example, the at least one drain opening 148 can be provided such that the drain opening 148 lies above at least a portion of at least one of the treating chemistry reservoirs 120, 122 to fluidly couple the drain opening 148 to the treating chemistry reservoir 120, 122.

The tool docking station 126 can further and optionally comprise a collecting portion 154 that underlies the at least one drain opening 148. The collecting portion 154 can be fluidly coupled to the at least one treating chemistry reservoir 120, 122 via a drain conduit 156. Thus, in any additional contemplated positions or locations (FIG. 7) of the tool docking station 126, the tool recess 132 can still be fluidly coupled to the at least one treating chemistry reservoir 120, 122, and thus to the treating chamber 18. Additionally, a water supply line, which can be the dispensing supply conduit 68, or a separate conduit fluidly coupled to and fed by the dispensing supply conduit 68, can be fluidly coupled to the tool recess 132, and thus also to the treating chamber 18 via the at least one drain opening 148 to aid in draining and/or rinsing of the tool recess 132.

Figure 6:
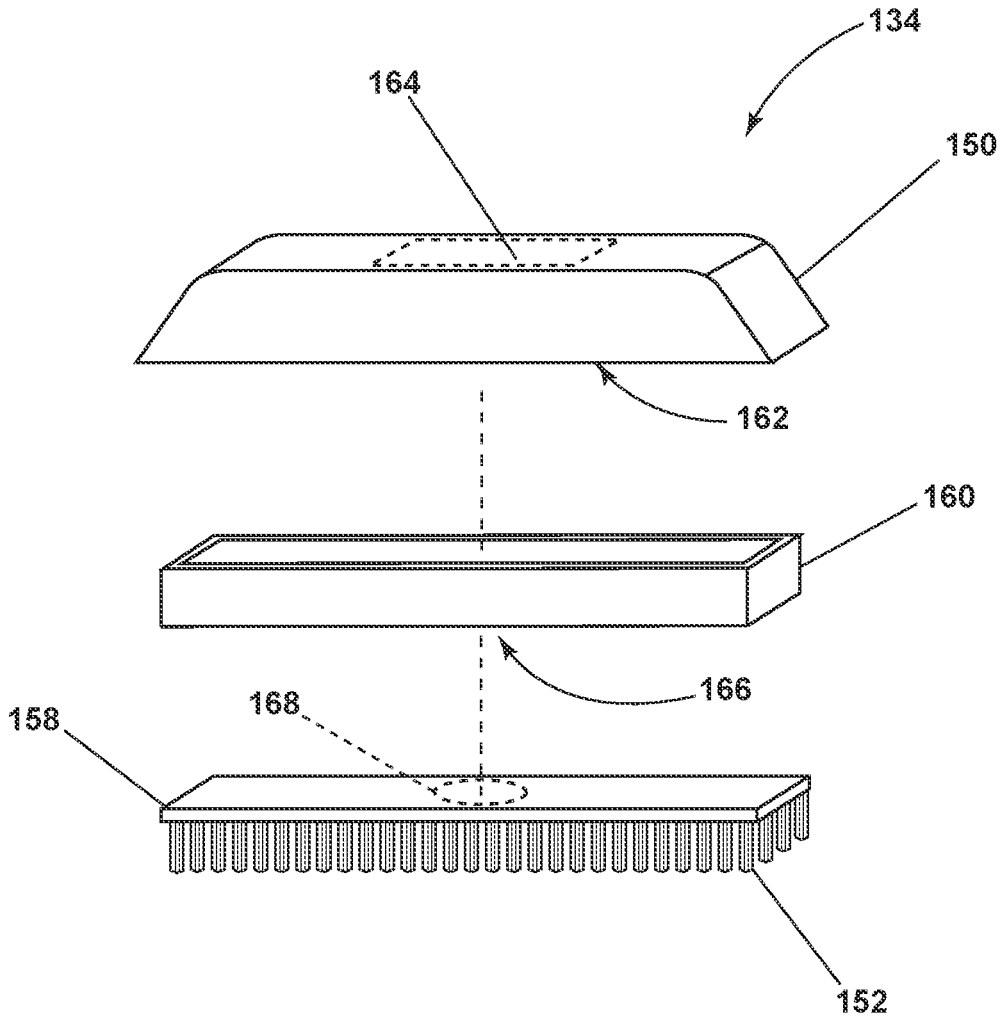
FIG. 6 is an exploded view of the treating tool of FIG. 3.

FIG. 6 is an exploded view of the treating tool 134. The treating tool 134, comprising the handle 150 and the set of bristles 152, can further comprise a tool body 158 to which the set of bristles 152 are attached. The tool body 158 can be received within or coupled to the handle 150. Complementary elements can be included to removably secure the handle 150 to the tool body 158. By way of non-limiting example, the tool body 158 and handle 150 can be configured with threads that can be screwed together, or edges that can snap together, although other coupling elements or methods can be used. An internal treating chemistry reservoir 160 can be provided within and carried by the treating tool 134. The internal treating chemistry reservoir 160 can be positioned between the tool body 158 and the handle 150. In one aspect, the internal treating chemistry reservoir 160 can be received within a tool body recess 162 formed in the handle 150, such that the internal treating chemistry reservoir 160 is located within the handle 150 when the treating tool 134 is assembled.

In one non-limiting example, the tool body recess 162 is at least partially located in the handle 150 and shaped to receive the internal treating chemistry reservoir 160. The internal treating chemistry reservoir 160 can be configured to receive a pretreating liquid or a chemistry pod. The internal treating chemistry reservoir 160 can be filled with pretreating liquid, for example, by opening the treating tool 134 and pouring liquid directly into the internal treating chemistry reservoir 160. In these aspects, the treating tool 134 can have a dispenser (not shown) that is operated by pushing on a compressible element 164 that activates a valve or conveys pressure to a liquid pump fluidly coupled to at least one of the internal treating chemistry reservoir 160 or the drain opening 148 to pump and to dispense the liquid in the internal treating chemistry reservoir 160 through the drain opening 148. When the treating tool 134 is docked within the tool docking station 126, this coupling further results in the contents of the internal treating chemistry reservoir 160 being pumped to the treating chamber 18. While the compressible element 164 is shown on the handle 150, other types and/or arrangements of dispensers can alternatively be used and incorporated into the treating tool 134.

The internal treating chemistry reservoir 160 can include a reservoir outlet 166. The tool body 158 can further comprise at least one tool outlet 168, which is fluidly coupled with the reservoir outlet 166. The tool outlet 168 can be adjacent or coextensive with the set of bristles 152 to allow the pretreating liquid to be released to the area of the set of bristles 152 from the internal treating chemistry reservoir 160. When the treating tool 134 is docked within the tool docking station 126, the internal treating chemistry reservoir 160 can be thought of as being fluidly coupled with the treating chamber 18 via the treating tool 134, the tool docking station 126, and the treating chemistry dispenser 60. Further, the tool outlet 168 can be understood to fluidly couple the internal treating chemistry reservoir 160 with the tool recess 132, and further to the treating chamber 18 via the drain openings 148. The drain opening 148 can be thought of as comprising a first fluid coupling, while the treating tool 134 can be thought of as comprising a second fluid coupling, wherein the second fluid coupling fluidly mates with the first fluid coupling when the treating tool 134 is docked and docked within the tool docking station 126 to fluidly couple the internal treating chemistry reservoir 160 to the drain opening 148. As disclosed previously, a water supply line, such as the dispensing supply conduit 68, can be provided and configured to supply water to the tool docking station 126, and to the tool recess 132, which can assist in flushing the treating chemistry from the treating tool 134 through the drain opening 148, and to the treating chamber 18.

It is noted that the treating tool 134 illustrated in FIG. 6 is merely an illustrative example of a treating tool 134 that can have a refillable internal treating chemistry reservoir 160 for holding and dispensing pretreating liquid. Alternatively, the tool body 158 and handle 150 of the treating tool 134 as illustrated in FIG. 5 can comprise a single piece with no internal treating chemistry reservoir 160, and can be used after manually applying the pretreatment liquid to the set of bristles 152, to the stain, or both. Other configurations and/or arrangements can also or alternatively be used.

Figure 7:
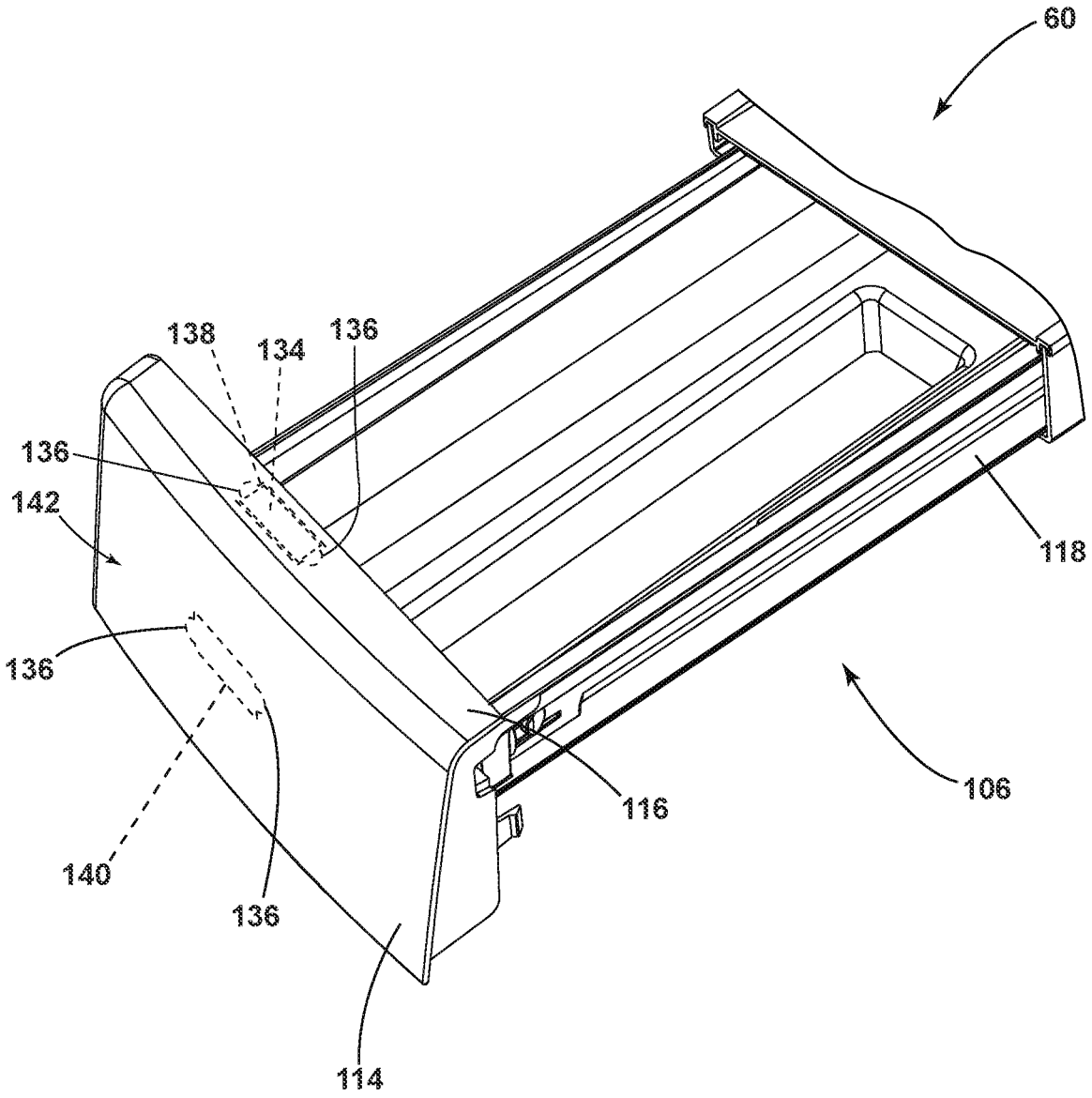
FIG. 7 is a perspective view of the dispenser of FIG. 1 illustrating alternate locations for the tool docking station according to aspects of the present disclosure.

While the tool docking station 126 has been illustrated herein as being provided within the drawer cover 124, FIG. 7 illustrates alternate locations for the tool docking station 126 within the treating chemistry dispenser 60 according to aspects of the present disclosure. In one aspect, a first alternate position 138 illustrates the tool docking station 126 as being provided within the peripheral edge 116 of the drawer front 114. In another aspect, a second alternate position 140 illustrates the tool docking station 126 as being provided within the front surface 142 of the drawer front 114. Other locations for the tool docking station 126 can be possible, and it will be understood that any suitable location on or within the treating chemistry dispenser 60 can be contemplated. When the tool docking station 126 is provided in the peripheral edge 116 or the front surface 142 of the drawer front 114, the tool docking station 126 and the at least one drain opening 148 may not directly overlie the treating chemistry reservoir 120, 122. In this case, optionally, and as shown in FIG. 5, the collecting portion 154 and drain conduit 156 can fluidly couple the drain opening 148 to the treating chemistry reservoir 120, 122.

Figure 8:
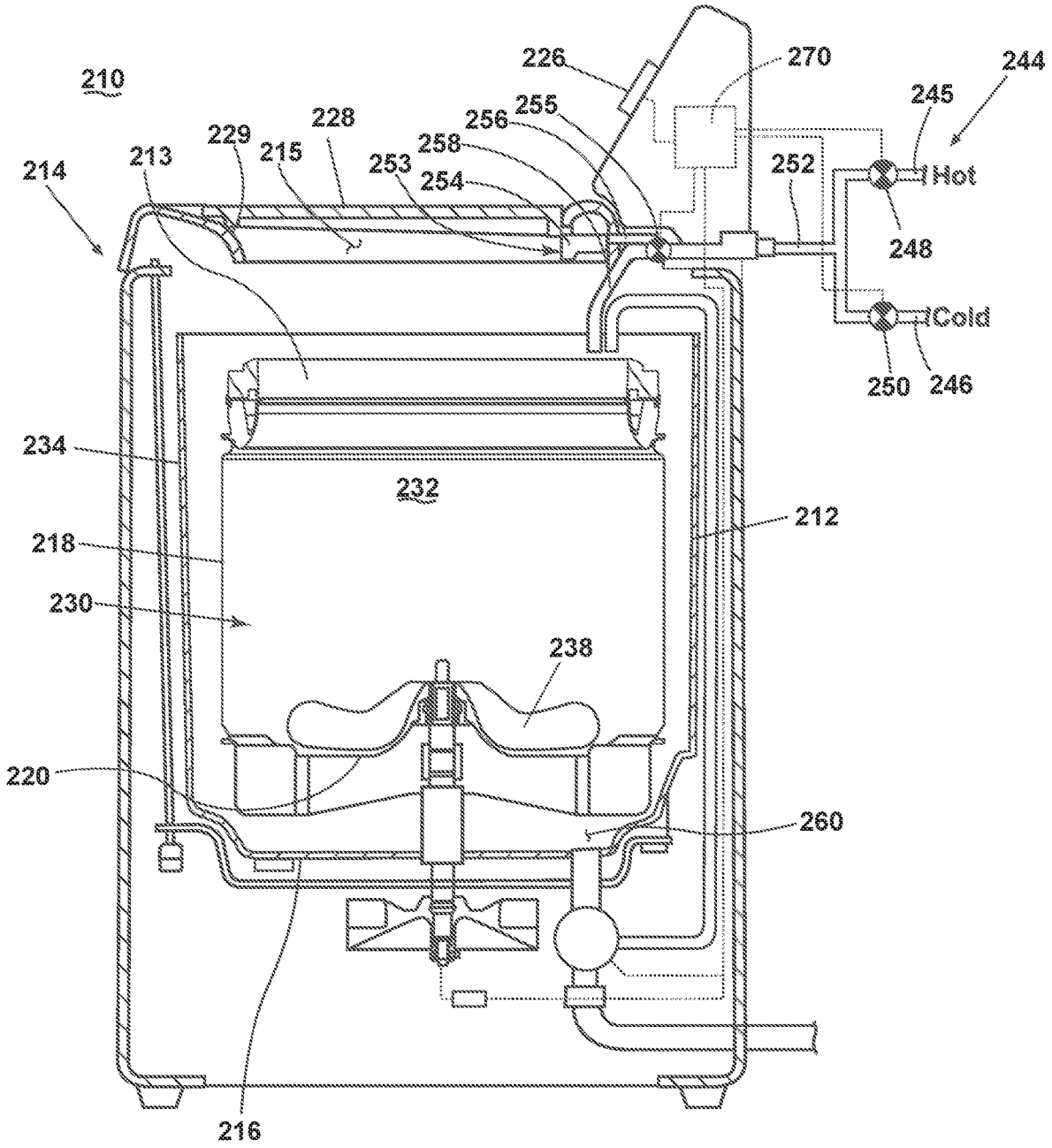
FIG. 8 is a schematic cross-sectional view of a laundry treating appliance in the form of a washing machine including a dispenser according to another aspect of the present disclosure.

Referring now to FIG. 8, a schematic sectional view of a laundry treating appliance is shown in the form of a vertical axis, top-fill washing machine 210 according to another aspect of the disclosure. The washing machine 210 can include a structural support system comprising a cabinet 214 that defines a housing, within which a laundry holding system resides. An access opening 215 can be provided in the cabinet 214 to access the laundry holding system. The cabinet 214 can be a housing having a chassis and/or a frame, to which decorative panels may or may not be mounted, defining an interior that receives components typically found in a conventional washing machine, such as motors, pumps, fluid lines, controls, sensors, transducers, and the like. Such components, similar to the components of the aspects of the disclosure described with respect to FIG. 1, will not be described further herein except as necessary for a complete understanding of the present disclosure.

The fabric holding system of the illustrated exemplary washing machine 210 can include a rotatable basket 230 having an open top 213 that can be disposed within the interior of the cabinet 214 and may define a treating chamber 232 for receiving laundry items for treatment. The open top can be aligned with the access opening 215. A tub 234 can also be positioned within the cabinet 214 and can define an interior within which the basket 230 can be positioned. The tub 234 can have a generally cylindrical side or tub peripheral wall 212 closed at its bottom end by a base 216 that can at least partially define a sump 260.

The basket 230 can have a generally peripheral side wall 218, which is illustrated as a cylindrical side wall, closed at the basket end by a basket base 220 to at least partially define the treating chamber 232. The basket 230 can be rotatably mounted within the tub 234 for rotation about a vertical basket axis of rotation and can include a plurality of perforations, such that liquid may flow between the tub 234 and the rotatable basket 230 through the perforations. While the illustrated washing machine 210 includes both the tub 234 and the basket 230, with the basket 230 defining the treating chamber 232, it is within the scope of the present disclosure for the laundry treating appliance to include only one receptacle, with the receptacle defining the laundry treatment chamber for receiving the load to be treated.

A shroud 229 is provided at the top of the cabinet 214 and can define the access opening 215. The shroud 229 can curve downwards toward the treating chamber 232 to direct laundry items into the basket 230. The shroud 229 can overlie a portion of the basket 230 such that the laundry items do not fall between the basket 230 and the tub 234. A selectively openable lid 228 can provide access into the laundry treating chamber 232 through the access opening 215 of the basket 230.

A laundry mover 238 may be rotatably mounted within the basket 230 to impart mechanical agitation to a load of laundry placed in the basket 230. The laundry mover 238 can be oscillated or rotated about its vertical axis of rotation during a cycle of operation in order to produce load motion effective to wash the load contained within the treating chamber 232. Other exemplary types of laundry movers include, but are not limited to, an agitator, a wobble plate, and a hybrid impeller/agitator.

A liquid supply system can be provided to provide liquid, such as water or a combination of water and one or more wash aids, such as detergent, into the treating chamber 232. The liquid supply system can include a water supply 244 configured to supply hot or cold water. The water supply 244 can include a hot water inlet 245 and a cold water inlet 246. A valve assembly can include a hot water valve 248, a cold water valve 250, and a diverter valve 255, and various conduits 252, 256, 258 for selectively distributing the water supply 244 from the hot water and cold water inlets 245, 246. The valves 248, 250 are selectively openable to provide water, such as from a household water supply (not shown) to the conduit 252. The valves 248, 250 can be opened individually or together to provide a mix of hot and cold water at a selected temperature. While the valves 248, 250 and conduit 252 are illustrated exteriorly of the cabinet 214, it may be understood that these components can be internal to the cabinet 214.

A dispensing system 253 can be provided for dispensing treating chemistry to the basket 230, either directly or mixed with water from the water supply 244. The dispensing system 253 can include a dispenser 254, which can be a single use dispenser, a bulk dispenser, or a combination of a single use and bulk dispenser in non-limiting examples. As illustrated, the dispenser 254 can be fluidly coupled with the conduit 252 through a diverter valve 255 and a first water conduit 256. The dispensing system 253 can include means for supplying or mixing detergent to or with water from the first water conduit 256. Alternatively, water from the first water conduit 256 can also be supplied to the tub 234 through the detergent dispenser 254 without the addition of a detergent. A second water conduit, illustrated as the water inlet 258, can also be fluidly coupled with the conduit 252 through the diverter valve 255 such that water can be supplied directly to the treating chamber through the open top of the basket 230.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply system and dispensing system 253 can differ from the configuration shown, such as by inclusion of other valves, conduits, wash aid dispensers, heaters, sensors, such as water level sensors and temperature sensors, and the like, to control the flow of treating liquid through the washing machine 210 and for the introduction of more than one type of detergent/wash aid.

The washing machine 210 can further include a controller 270 coupled with various working components of the washing machine 210 to control the operation of the working components and to implement one or more treating cycles of operation. A user interface 226 can be operably coupled with the controller 270. The user interface 226 can include one or more knobs, dials, switches, displays, touch screens and the like for communicating with the user, such as to receive input and provide output. The user can enter different types of information including, without limitation, cycle selection and cycle parameters, such as cycle options.

The controller 270 can be operably coupled with one or more components of the washing machine 210 for communicating with and/or controlling the operation of the components to complete a cycle of operation. For example, the controller 270 can be coupled with the hot water valve 248, the cold water valve 250, the diverter valve 255, and the dispenser 254 for controlling the temperature and flow rate of treating liquid into the treating chamber 232, and the user interface 226 for receiving user selected inputs and communicating information to the user.

Figure 9:
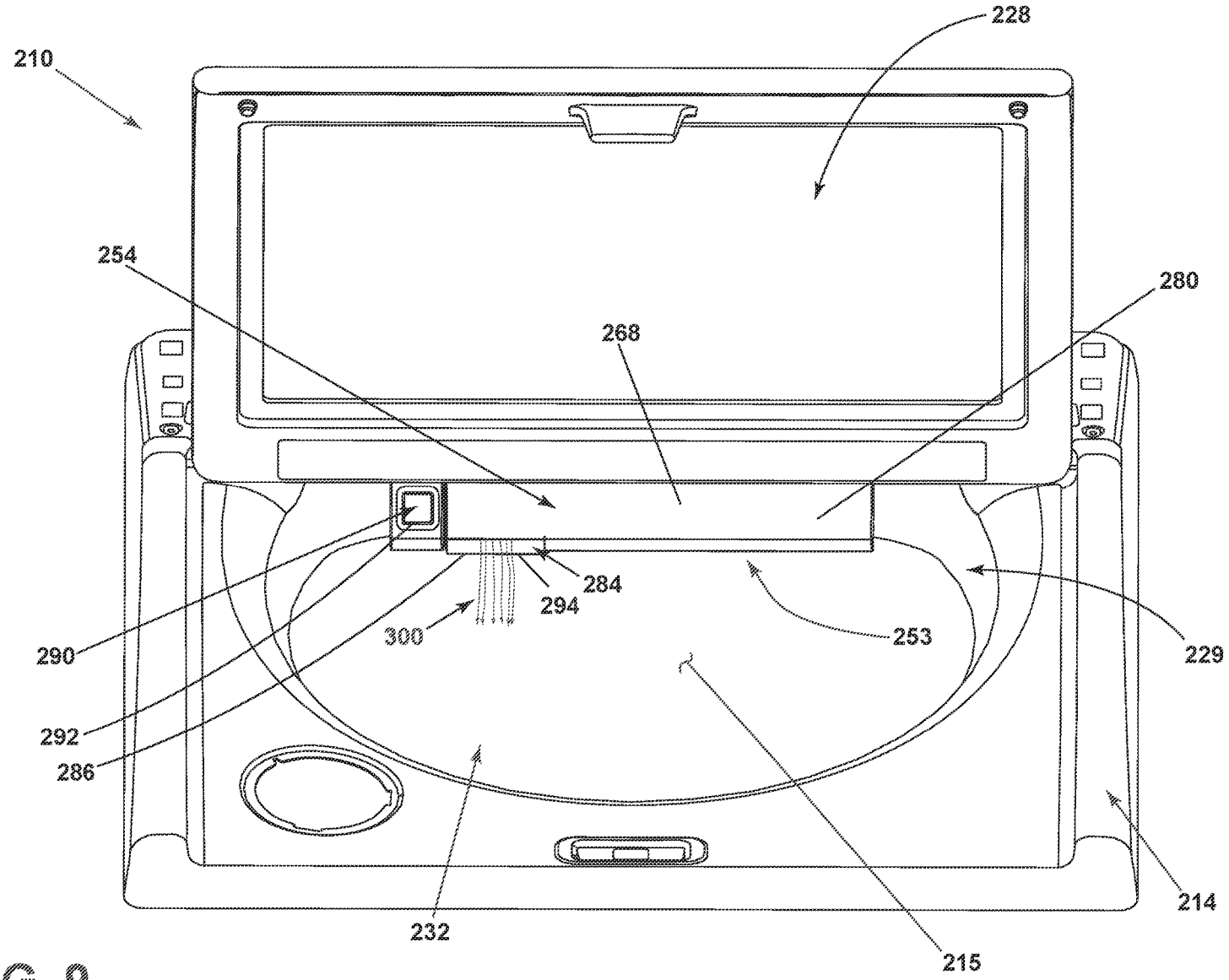
FIG. 9 illustrates a top view of an opening in the laundry treating appliance of FIG. 8 with the dispenser in a closed condition.

Looking now at the dispensing system 253 in greater detail, reference is made to FIG. 9, which illustrates a top view of a washing machine 210 showing the dispensing system 253 having a pre-treatment faucet 284. For ease of viewing, the lid 228 is shown in the opened position to illustrate the relative positions of the dispenser 254, shroud 229 and access opening 215. More specifically, the dispenser 254 can be provided in (and may partially form) the shroud 229 toward the rear of the access opening 215, though any other suitable position of the dispenser 254 is contemplated. The dispenser 254 can include a drawer 280 movable or slidable between a closed, first position (FIG. 9) and an opened, second position (FIG. 10) relative to the shroud 229. The drawer 280 of the dispenser 254 can further include a front panel 268, which forms a portion of the shroud 229 in the closed, first position.

The faucet 284 can be provided on the drawer 280. The faucet 284 can underlie the shroud 229 when the drawer 280 is in the closed, first position. The faucet 284 has an outlet 286 provided in the front panel 268 of the dispenser 254. The outlet 286 can be formed as an aperture in the drawer 280 or the shroud 229. A pre-treatment water flow, or supply of water 300, can be provided from the faucet 284 at the outlet 286, and dispensed to the treating chamber 232 through the access opening 215. In particular, the supply of water 300 can be provided from the dispenser 254 at the faucet 284. When the drawer 280 is in the first position the supply of water 300 can be directed in a stream flowing out of the outlet 286 in the faucet 284 and toward the treating chamber 232 in a downward direction.

An actuator 290 can operably couple to the dispenser 254 to control the supply of water 300 from the faucet 284. A user can operate the actuator 290 to utilize the faucet 284 for pre-treatment of laundry items. In this illustrative example, the actuator 290 is in the form of a switch 292. However, the actuator 290 can be any suitable actuable element, such as a switch, button, dial, or knob. The actuator 290 can be provided on the shroud 229 or the dispenser 254, such that the actuator 290 is accessible through the access opening 215 while the lid 228 is in the opened position. While the actuator 290 is shown as being located on the shroud 229, the actuator 290 can be located on any other suitable location accessible by a user, such as on the cabinet 214, drawer 280, or user interface 226. The actuator 290 can be a mechanical actuator wherein the supply of water 300 is controlled by way of a mechanical operation, or the actuator 290 can be an electrical actuator wherein the supply of water 300 is controlled by way of an electric signal or current. Alternatively, it is contemplated that any suitable operable control mechanism be used to control the supply of water 300.

When the lid 228 is open, the faucet 284 is accessible and enables a user utilize the faucet 284 to dispense water onto fabric items for pre-treatment. After the lid 228 is closed and the washing machine 210 begins an automatic cycle of operation, the faucet 284 should not further dispense water. Instead, the treating chemistry containers 281, 283, 285 can dispense treating chemistry for use during the automatic cycle of operation.

In use, the faucet 284 can be used to treat a laundry item prior to the washing machine 210 running an automatic cycle of operation. In a first example, a laundry item can be placed underneath the faucet 284 in the trajectory of the supply of water 300 flowing out of the outlet 286. The user can actuate the actuator 290 to start the supply of water 300 from the faucet 284. The laundry item can be at least partially saturated with the supply of water 300. The wet laundry treating item can be treated by the user, such as rubbing or brushing a stain using a treating tool 334 (FIG. 10) on the wet laundry item. In another example, before or after the laundry item is wetted using the faucet 284, a treating chemistry such as a stain-remover can be applied to the laundry item by using the treating tool 334. The user can then treat the laundry item with the stain-remover having been wet by the water supplied from the faucet 284. To treat the laundry item a user may wish to scrub the wet portion of the laundry item with the treating tool 334.

Figure 10:
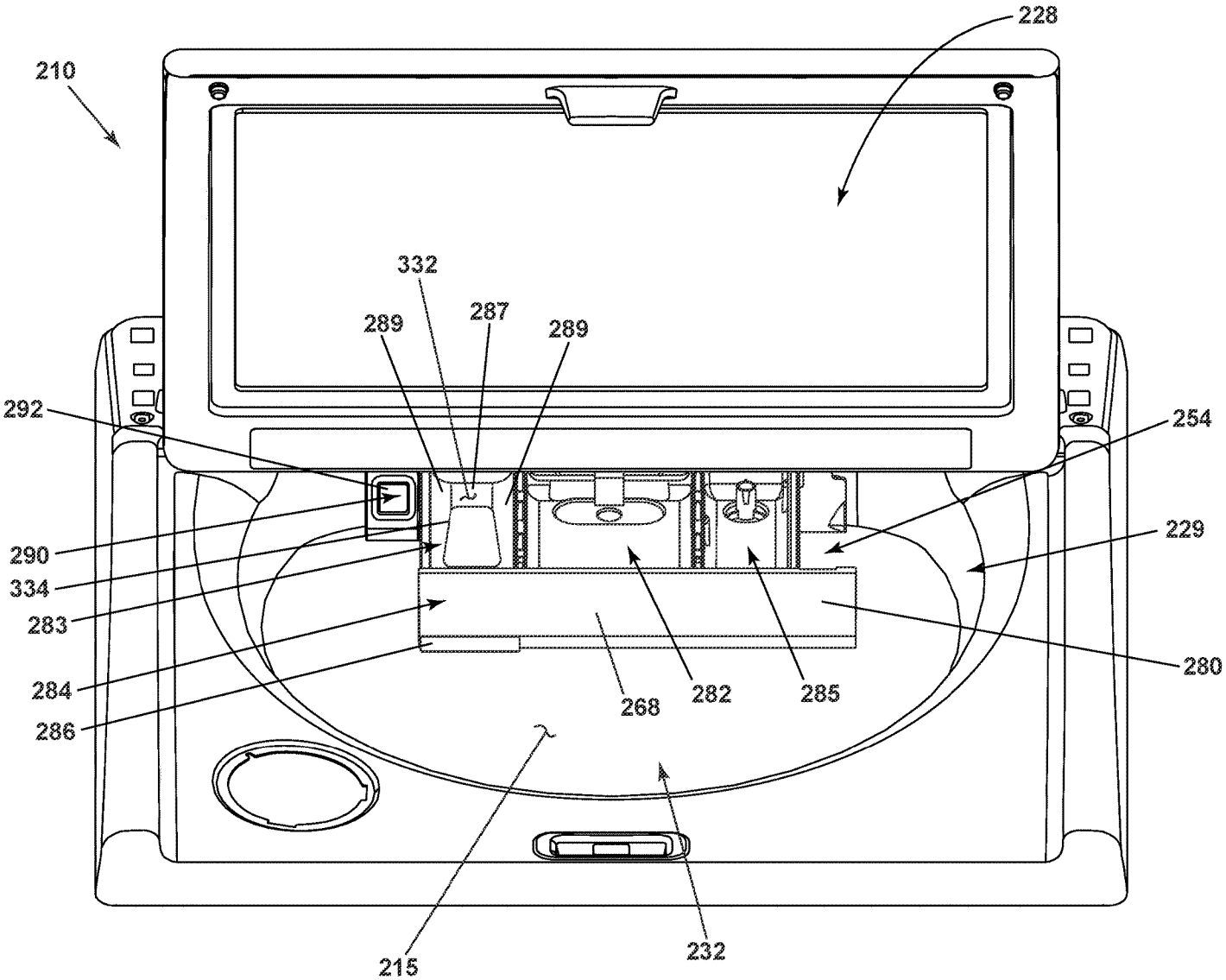
FIG. 10 illustrates a top view of the dispenser of FIG. 9 in an opened condition and with a treating tool docked in a tool docking station.

FIG. 10 illustrates the washing machine 210 with the drawer 280 of the dispenser 254 slid out of the shroud 229 in the opened, second positon. While the drawer 280 is in the second position, the faucet 284 can extend at least partially beyond the shroud 229 and overlie the basket 230 into the access opening 215 such that the outlet 286 extends beyond the shroud 229.

A set of one or more containers, shown here as a first container 281, a second container 283, and a third container 285, can be carried by the drawer 280. The containers 281, 283, and 285 can hold differing types of liquids or powders, such as water or treating chemistry including detergent, fabric softener, or stain repellent. It is also contemplated that at least two of the containers 281, 283, and 285 are different in volume. Furthermore, the particular containers 281, 283, and 285 can be tailored to particular treating chemistries, and can include indicia or labelling to identify the particular intended treating chemistries.

At least one of the containers 281, 283, and 285 can be adapted to facilitate water flow for the faucet 284. In this example, the second container 283 at least partially defines the faucet 284 and can include the outlet 286. As such, the drawer 280 including the second container 283 can at least partially form the faucet 284 as described herein. The second container 283 includes a bottom 287 and sides 289 such that a volume of water or treating chemistry is constrained within the second container 283. The outlet 286 can be provided in the bottom 287 or the sides 289 of the second container 283, providing egress for water or treating chemistry within the second container 283. This enables the pre-treatment water faucet functionality to be provided within the structure of the dispenser drawer 280, resulting in a simple, low-complexity, and low-cost implementation.

The second container 283 can further define a tool recess 332 and include a tool docking station 326 (FIG. 11) to which the treating tool 334 can be docked. It will be understood that previous description of the treating tool 134 applies herein to the treating tool 334 as well and can include the same features and properties.

Figure 11:
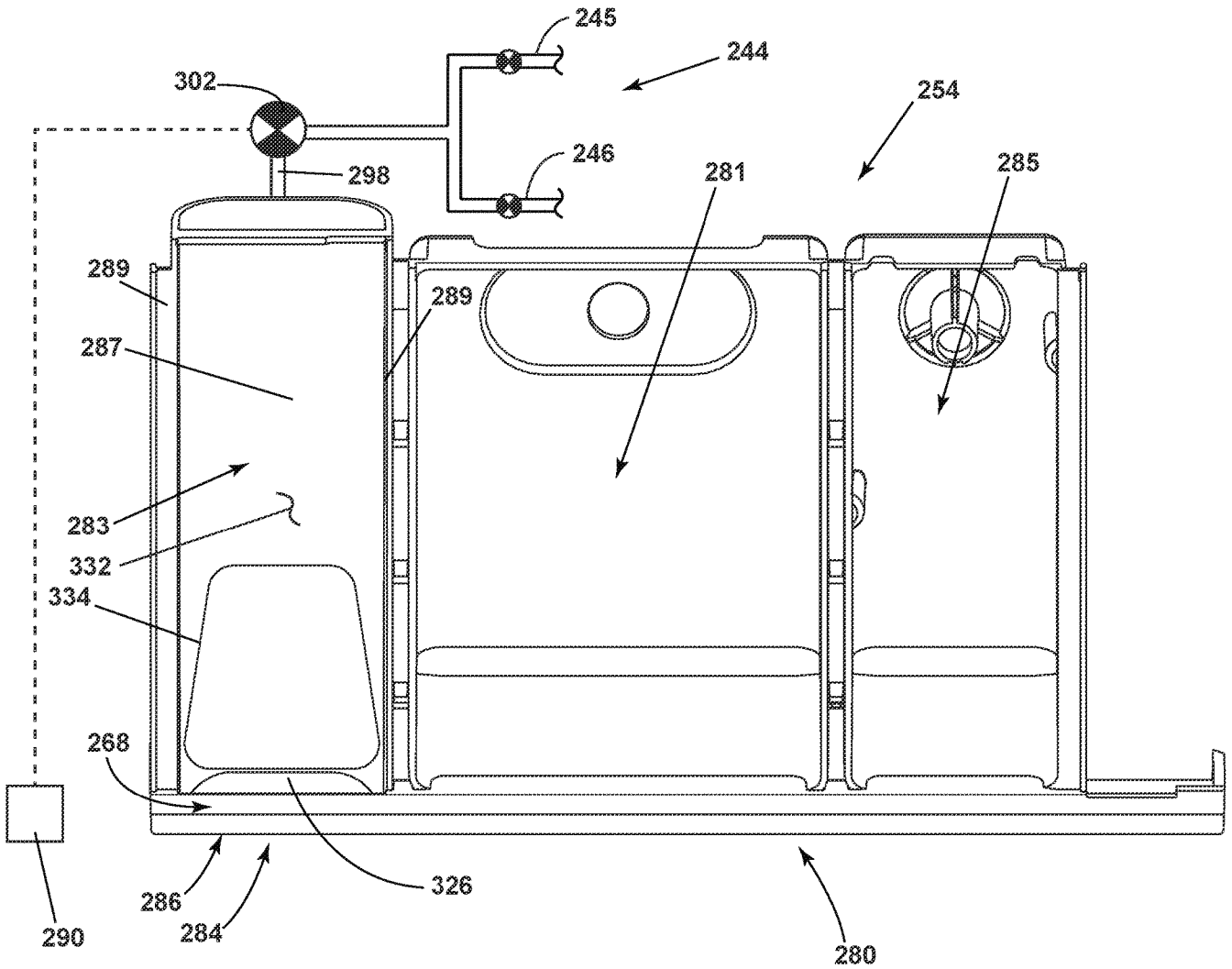
FIG. 11 illustrates a top view of the drawer and treating tool of FIG. 10.

Turning to FIG. 11, a top view of the dispenser drawer 280 and treating tool 334 is shown schematically coupled to the water supply 244. The outlet 286 can be provided in the bottom 287 or sides 289 of the second container 283. The outlet 286 can further include a nozzle to facilitate the flow of water from the outlet 286. A water line 298 can fluidly couple the water supply 244 to the dispenser 254. The water line 298 can be coupled at the second container 283, and can be movable to accommodate slidable movement of the drawer 280. While the water line 298 is shown to only couple the second container 283, the water line 298 can fluidly couple any of the containers 281, 283, and 285. A valve 302 can be provided at a junction between the water supply 244 and the water line 298 for selectively supplying water to the water line 298. The valve 302 can be any suitable valve, such as a diverter valve. The valve 302 can be operably coupled to the actuator 290 to selectively open and close the water line 298 to selectively provide water to the faucet 284.

The valve 302 can be supplied with both the hot water inlet 245 and the cold water inlet 246 and can control the temperature based upon instruction from the actuator 290. The actuator 290 can allow a user to choose the temperature of water supplied to the second container 283 by operating valves associated with the hot water inlet 245 or the cold water inlet 246 from the valve 302. Alternatively, water temperature can be controlled at the user interface.

Upon actuation of the actuator 290, the valve 302 can provide the supply of water via the water supply 244 to the water line 298 through the valve 302. The supply of water via the water supply 244 is passed to the second container 283 and can then exit the faucet 284 at the outlet 286. Thus, the supply of water can be used to saturate a laundry item with the supply of water 300, while still containing spill-over water within the treating chamber 232.

The tool docking station 326 can be provided within the tool recess 332 defined by the second container 283. The treating tool 334 can couple with the tool docking station 326 in any suitable manner, such as by coupling only along a single edge of the treating tool 334 by a snap fit arrangement, a slidable arrangement, or a magnetic coupling between the treating tool 334 and the tool docking station 326. The treating tool 334 can dock with the tool docking station 326 such that the treating tool 334 rests on the bottom 287 or just above the bottom 287 of the second container 283. This allows water that is passing through the second container 283 to the outlet 286 to pass the treating tool 334 and to rinse the treating tool 334 and the set of bristles, such that the outlet 286 acts as a drain for the tool recess 332.

The faucet 284 can dispense water alone, or water mixed with treating chemistry. For example, the supply of water provided by the faucet 284 can include a stain treating chemistry to pre-treat laundry items prior to washing. A user can also or alternatively fill the second container 283 with a pre-treating chemistry or other treating chemistry prior to actuation of the actuator 290, such as by dispensing a treating chemistry from the treating tool 334 as described previously. At actuation of the actuator 290 the supply of water passes through the second container 283 to mix with the treating chemistry to form a mixed supply. The mixed supply exists the outlet 286 and is supplied from the faucet 284 to the treating chamber for pre-treatment of laundry. Alternately, if the user does not fill the second container 283 with a treating chemistry, the supply of water does not mix with treating chemistry.

In use, the user can open the drawer 280 and fill the second container 283 with a volume of treating chemistry, such as a stain-treatment, by dispensing such a volume of treating chemistry from the treating tool 334, or simply by using the treating tool 334 to stain treat a laundry item and allowing the residual treating chemistry retained on the treating tool 334 after use to collect within the second container 283, which the treating tool 334 overlies when docked with the tool docking station 326. The user can close drawer 280 with the treating chemistry retained in the second container 283. The user can then actuate the actuator 290 to provide the supply of water 300 to the second container 283 to mix with the treating chemistry. The mixture of water and treating chemistry is dispensed from the faucet 284 where a user can use the mixture of water and treating chemistry to at least partially saturate a laundry item. The user can then treat the laundry item, such as by rubbing the laundry item with the user's hands or by using the treating tool 334, or another brush, sponge, or other suitable treatment utensil. Alternatively, the user could simply wet the laundry item with the mixture of water and chemistry prior to running a cycle of operation, without treating the laundry item, to provide for increased treatment to desired laundry items or portions of laundry items.

The dispenser 254 obviates the need for an external sink or space for pre-washing or pre-treating laundry. Having the faucet 284 integrated into the dispenser 254 can enable a user to pre-treat laundry items prior to running a cycle of operation, while containing any liquid or treating chemistry within the treating chamber of the washing machine. The dispenser 254 also minimizes or eliminates additional space otherwise required to route the supply of water 300 as the supply of water 300 can already be supplied to the dispenser 254 for providing treating chemistry to the treating chamber.

The aspects of the present disclosure provide a treating tool that can be conveniently docked in a tool docking station for ease of use by a user. By incorporating the tool docking station into an already existing treating chemistry dispenser, no additional space is taken up, but the user can still be provided with easy access to the treating tool for pre-treatment of laundry items. Furthermore, by incorporating the tool docking station within the treating chemistry dispenser, the tool docking station can be fluidly coupled to the treating chamber and have water supplied to the tool docking station to rinse residual or dispensed treating chemistry away from the tool docking station and the treating tool. By incorporating a treating chemistry reservoir within the treating tool, performance of pre-treatment can be improved even further and can provide a greater degree of user control over a pre-treatment process or the ability to add a pre-treating agent to the treating chamber simply by dispensing from the treating tool.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. All combinations or permutations of features described herein are covered by this disclosure.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the appended claims. Hence, specific dimensions and other physical characteristics relating to the aspects of the present disclosure are not to be considered as limiting, unless expressly stated otherwise.

What is claimed is:

1. A laundry treating appliance comprising:
a chassis defining an interior;
a treating chamber located within the interior;
a drawer slidably received within the interior and containing a dispenser having at least one treating chemistry reservoir fluidly coupled to the treating chamber; and
a treating tool having an internal treating chemistry reservoir and positioned within the dispenser to fluidly couple the internal treating chemistry reservoir with the treating chamber.

2. The laundry treating appliance of claim 1, wherein the treating tool comprises a brush with a handle having bristles extending from the handle.

3. The laundry treating appliance of claim 2, wherein the internal treating chemistry reservoir is located within the handle.

4. The laundry treating appliance of claim 1, further comprising a tool docking station located within the drawer and comprising a recess in which the treating tool is received.

5. The laundry treating appliance of claim 4, wherein the recess comprises a drain that is fluidly coupled to the treating chamber.

6. The laundry treating appliance of claim 5, further comprising a water supply line fluidly coupled to the recess, such that water supplied to the recess can be supplied to the treating chamber via the drain.

7. The laundry treating appliance of claim 6, wherein the treating tool comprises an outlet fluidly coupling the internal treating chemistry reservoir to the recess, wherein water supplied to the recess via the water supply line flushes a treating chemistry down the drain to the treating chamber.

8. The laundry treating appliance of claim 5, wherein the drain comprises a first fluid coupling and the treating tool comprises a second fluid coupling which fluidly mates with the first fluid coupling when the treating tool is docked with the tool docking station to fluidly couple the internal treating chemistry reservoir to the drain.

9. The laundry treating appliance of claim 8, further comprising a pump fluidly coupled with at least one of the internal treating chemistry reservoir and the drain to pump the contents of the internal treating chemistry reservoir through the drain and to the treating chamber.

10. The laundry treating appliance of claim 4, wherein the tool docking station is located in a peripheral edge of the drawer.

11. The laundry treating appliance of claim 4 wherein the tool docking station is fluidly coupled to the at least one treating chemistry reservoir to fluidly couple the tool docking station to the treating chamber.

12. A laundry treating appliance comprising:
a chassis defining an interior;
a treating chamber located within the interior and having a fluid inlet;
a removable treating tool having an internal treating chemistry reservoir with a fluid outlet; and
a fluid coupling between the fluid outlet of the internal treating chemistry reservoir and the fluid inlet of the treating chamber.

13. The laundry treating appliance of claim 12, further comprising a dispenser within the interior and having at least one treating chemistry reservoir fluidly coupled to the treating chamber.

14. The laundry treating appliance of claim 13, further comprising a drawer slidably received within the interior and containing the dispenser.

15. The laundry treating appliance of claim 14, further comprising a tool docking station located within the drawer and comprising a recess in which the removable treating tool is received.

16. The laundry treating appliance of claim 15 wherein at least a portion of the tool docking station overlies the at least one treating chemistry reservoir to at least partially form the fluid coupling.

17. The laundry treating appliance of claim 15, further comprising a water supply line fluidly coupled to the recess such that water supplied to the recess can be supplied to the treating chamber via the drain.

18. The laundry treating appliance of claim 15, wherein the fluid outlet of the removable treating tool is fluidly coupled to the recess when the removable treating tool is docked with the tool docking station, wherein water supplied to the recess via the water supply line flushes a treating chemistry down the drain to the treating chamber.

19. The laundry treating appliance of claim 18, wherein the drain comprises a first fluid coupling, and wherein the fluid outlet of the removable treating tool fluidly mates with the first fluid coupling when the treating tool is docked with the tool docking station to fluidly couple the internal treating chemistry reservoir to the drain.

20. The laundry treating appliance of claim 12, wherein the removable treating tool comprises a brush including a handle with bristles extending from the handle, wherein the internal treating chemistry reservoir is located within the handle.

* * * * *